United States Patent [19]

DeCesare

[11] 4,023,458

[45] May 17, 1977

[54] TOY PIANO

[76] Inventor: Dominic DeCesare, 223 Center St., Elizabeth, N.J. 07202

[22] Filed: May 5, 1976

[21] Appl. No.: 683,377

[52] U.S. Cl. ..... 84/236; 84/244; 84/404; 84/405

[51] Int. Cl.[2] ..... G10C 3/16

[58] Field of Search ..... 84/236, 237, 240, 243, 84/244, 245, 246, 402, 403, 404, 405, 406, 407

[56] References Cited

UNITED STATES PATENTS

| | | | |
|---|---|---|---|
| 913,990 | 3/1909 | Soblik | 84/245 |
| 1,285,299 | 11/1918 | Marx | 84/404 |
| 1,707,057 | 3/1929 | Fusch | 84/404 |
| 2,641,153 | 6/1953 | Enochs et al. | 84/404 |

FOREIGN PATENTS OR APPLICATIONS

| | | | |
|---|---|---|---|
| 388,060 | 2/1933 | United Kingdom | 84/245 |

*Primary Examiner*—Lawrence R. Franklin

[57] ABSTRACT

A toy piano has a set of sound-producing elements disposed within a frame, and a set of key-shaped levers pivotably supported on the frame along a normally horizontal axis for movement from a first position to a second position, respectively. A set of hammers is pivotably disposed within the frame for striking the sound-producing elements; the hammer-contacting ends of the levers normally rest on the hammers, respectively, for preventing the release thereof. The sound-producing means are actuated either manually by depressing one of the levers and releasing it thereafter so that a corresponding hammer is then made to impinge on one of the sound-producing elements, or automatically when a cam-shaft is permitted to periodically strike at least one of the released hammers.

8 Claims, 4 Drawing Figures

TOY PIANO

BACKGROUND OF THE INVENTION

1. Field of the Invention

The field of the invention relates to a toy piano.

2. Description of the Prior Art

A toy musical instrument is known wherein a vibrator operates a hammer, the latter periodically engaging a tone bar causing a sound effect to be produced by the latter; this produces a tremolo effect. Another toy piano is known wherein a revolving shaft engages a tone bar to cause a sound to be produced thereby. The rings periodically engaging the tone bar also produce a tremolo effect closely resembling the tone which is obtained by electric organs. Still another vibrating-bar musical instrument is known employing rotating closure plate disposed over respective resonators. This latter arrangement results in rhythmic pulsations yielding a vibrator effect.

No toy piano is known, however, where the depression of a key of the piano keyboard produces a bell-like rhythmic ringing effect best described as a piano sound rhythmically operated at a frequency resembling the ring of a telephone.

SUMMARY OF THE INVENTION

It is therefore an object of my present invention to produce a sound effect closely resembling the sound of a piano key being rhythmically repeated at a frequency close to the frequency of the ring of a telephone.

I consequently provide a toy piano which includes a frame, a set of sound-producing elements disposed within the frame and spaced from one another, a set of key-shaped levers pivotably supported on the frame along a normally horizontal axis for movement from a first position to a second position, respectively, a set of hammers pivotably disposed within the frame along a normally horizontal axle parallel with the axis for striking the sound-producing elements, respectively, a gap being normally formed between each of the hammers and each of the sound-producing elements, respectively. Each of the levers has a key-end and a hammer-contacting end; the hammer contacting ends normally rest on the hammers, respectively, for preventing the release thereof in the first positions of the levers. A limit-stop means is provided for each of the released hammers to impinge upon to limit the travel of the latter. Upon depression of the key-shaped levers and the movement thereof from the first to the second position one of the hammers is released to swing freely to, and come to rest on the limit-stop means.

Key-stop means attached to the frame are provided for the levers to rest thereon in the first position; upon release of one of the key-shaped levers following the depression thereof the latter reverts to the first position, thereby pushing a corresponding one of the hammers to impinge on one of the sound-producing elements.

The limit-stop means comprises cam-shaft means disposed parallel to the horizontal axis for striking the released hammers, and drive means are provided for rotating the cam-shaft means. The latter has a pulley attached thereto and the drive means is preferably an electric motor and a belt engageable therewith and with the pulley. The electric motor is preferably a battery-driven motor, and the frame is formed with a storage space for receiving a battery to energize the motor.

The sound-producing means are pre-tuned bars, and preferably a pre-tuned metal-assembly. A switch is provided on the piano for switching the drive means on and off.

BRIEF DESCRIPTION OF THE DRAWING

My invention will be better understood with reference to the accompanying drawing in which.

DESCRIPTION OF THE PREFERRED EMBODIMENT

Figure 1:
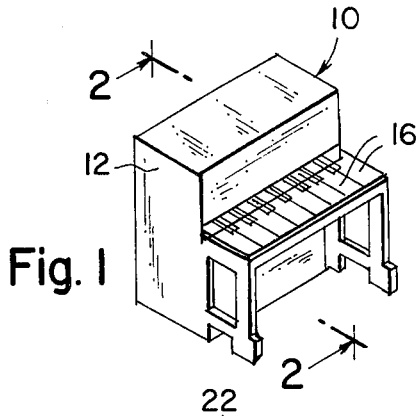
FIG. 1 shows a perspective view of the electric piano according to my invention.
Figure 3:
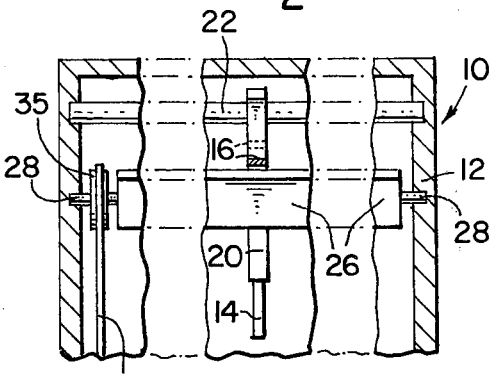
FIG. 3 is a cross-section of FIG. 1 along the lines 3—3.
Figure 2:
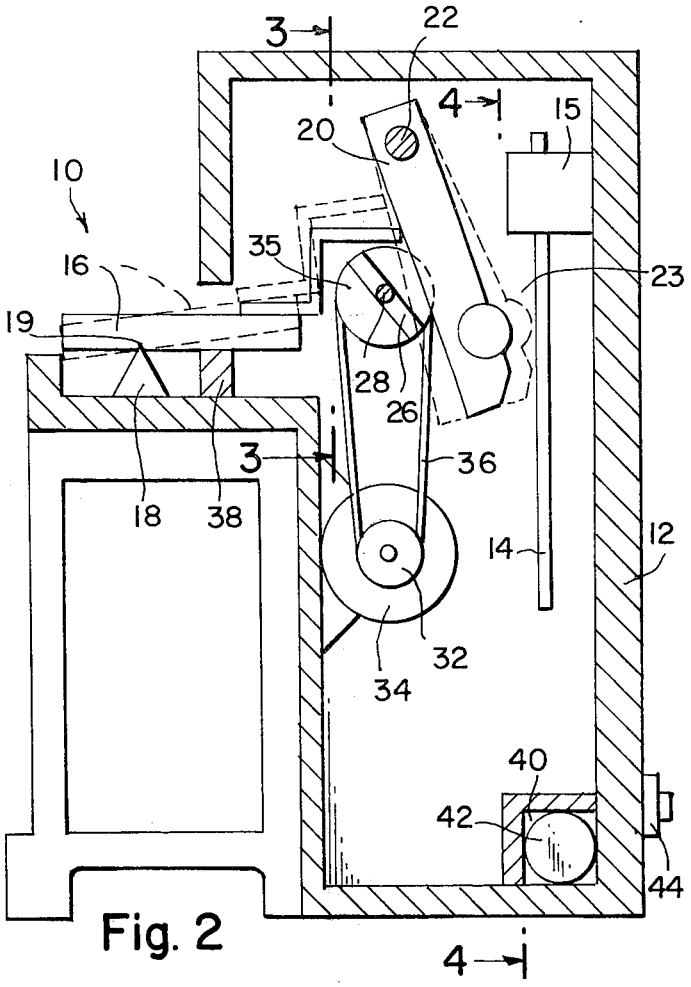
FIG. 2 is a cross-section along the lines 2—2 of FIG. 1.
Figure 4:
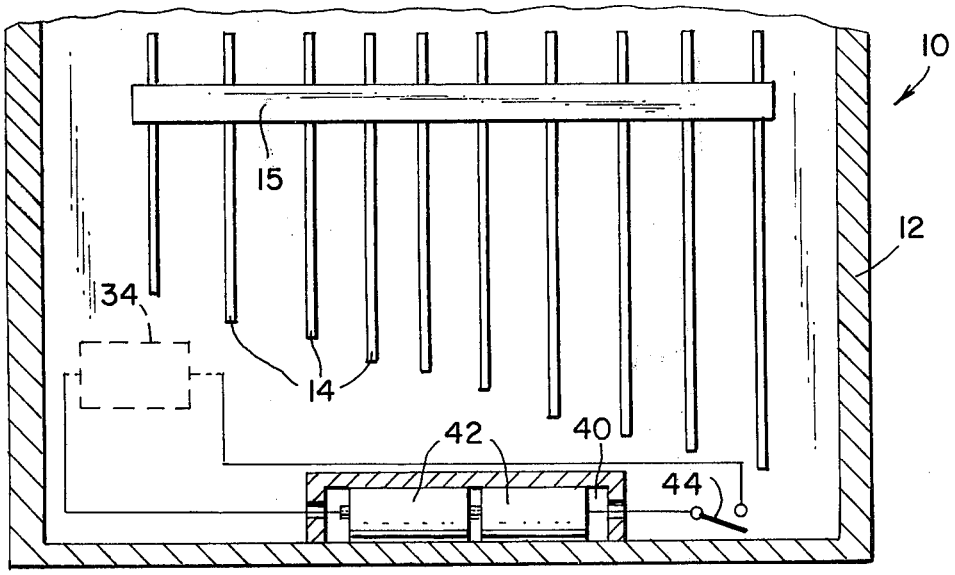
FIG. 4 is a cross-section of FIG. 1 along the lines 4—4.

Referring now to the drawing, a piano 10 includes a frame 12, a set of sound-producing elements 14 which are attached by means of a holder 15 to the frame and spaced from one another, a set of key-shaped levers 16, which are supported on the frame 12 about pivots 18 along a horizontal axis 19 for movement from a first position to a second position, respectively, a set of hammers 20 pivotably disposed within the frame 12 along normally horizontal axle 22 parallel with the horizontal axis 19 for striking the sound-producing elements 14, respectively. A gap 23 is normally formed between each of the hammers 20 and each of the sound-producing elements 14, respectively, and each of the levers 16 has a key-end and a hammer-contacting end. The hammer-contacting ends normally rest on the hammers 20, respectively, for preventing the release thereof in the first positions of the levers 16. A limit-stop means 26 is providrd for each of the released hammers 20 to impinge upon, for example, by the force of gravity, to limit the travel of the latter. Upon depression of one of the key-shaped levers 16 and the movement thereof from the first to the second position, one of the hammers 20 is released so that it can swing freely to, and come to rest on the limit-stop means.

Key-stop means 38 are attached to the frame 12 for the levers 16 to rest thereon in the first position. Upon release of one of the key-shaped levers 16 following the depression thereof the latter reverts to the first position, thereby pushing a corresponding one of the hammers 20 to impinge on one of the sound-producing elements 14.

The limit-stop means 26 includes a cam-shaft 28 which is disposed parallel to the horizontal axis for striking the released hammers 20. Drive means 34, for example, in the form of an electric motor, are provided to rotate the cam-shaft 28. The latter has a pulley 32 attached thereto, and a belt 36 engages with the motor 34 and a pulley 35 rigidly attached to cam-shaft 28.

The motor 34 is preferably a battery-driven motor and the frame 12 is preferably formed with a storage space 40 for receiving a battery 42 to energize the electric motor. The sound-producing means 14 are pre-tuned bars, and preferably a pre-tuned metal-assembly. A switch 44 is provided to switch the motor 34 on and off.

Although the invention has been described with respect to a preferred version thereof, it is to be understood that it is not to be so limited since changes can be made therein which are within the full intended scope of the appended claims.

I claim:

1. A toy piano comprising:

a frame;

a set of sound-producing elements disposed within said frame and spaced from one another;

a set of hammers pivotably disposed within said frame along a normally horizontal axle for striking said sound-producing elements;

a set of key-shaped levers, each of which have a key-end and a hammer-contacting end, pivotably supported on said frame along a normally horizontal axis parallel to said axle for movement from a first position where said key-end is undepressed to a second position where said key-end is depressed;

means biasing said levers to said first position;

each of said hammers normally resting on one of said lever's hammer-contacting end in said first position to form a gap between said hammer and one of said sound-producing elements, said hammer being released to move away from said sound-producing element by movement of said lever to said second position;

limit-stop means for each of said released hammers to impinge upon to limit said hammer's movement away from said sound producing element; and said hammer being pushed by said hammer-contacting end under the force of said biasing means to impinge on said sound-producing element by movement of said lever from said second to said first position.

2. A toy piano according to claim 1 further comprising key-stop means attached to said frame for said lever to rest thereon in said first position.

3. A toy piano according to claim 1 wherein said limit-stop means comprises cam-shaft means disposed parallel to said horizontal axis for striking the released hammers and further comprising drive means for rotating said cam-shaft means.

4. A toy piano according to claim 3 wherein said cam-shaft means has a pulley attached thereto and said drive means comprises an electric motor and a belt engageable therewith and said pulley.

5. A toy piano according to claim 4 wherein said electric motor is a battery-driven motor and wherein said frame is formed with storage space for receiving a battery to energize said motor.

6. A toy piano according to claim 5 wherein said sound-producing means are pre-tuned bars.

7. A toy piano according to claim 6 wherein said pre-tuned bars are a pre-tuned metal-assembly.

8. A toy piano according to claim 3 further comprising switch means disposed on said frame for switching said drive means on and off.

* * * * *